United States Patent [19]

McEver et al.

[11] Patent Number: 4,823,871

[45] Date of Patent: Apr. 25, 1989

[54] HANGER AND SEAL ASSEMBLY

[75] Inventors: James P. McEver, Cypress; David H. Theiss, Houston, both of Tex.

[73] Assignee: Cameron Iron Works USA, Inc., Houston, Tex.

[21] Appl. No.: 159,946

[22] Filed: Feb. 24, 1988

[51] Int. Cl.[4] ..... E21B 33/04

[52] U.S. Cl. ..... 166/182; 166/208; 277/116.2; 277/116.8; 277/124; 277/236; 285/140

[58] Field of Search ..... 166/208, 182, 123, 125, 166/85, 195, 196; 277/236, 115, 116, 117, 116.6, 116.8, 123, 125, 168, 169, 170, 206 A, 206 R; 285/140–143, 348, 347, 351, 338, 18

[56] References Cited

U.S. PATENT DOCUMENTS

| | | | |
|---|---|---|---|
| 3,273,646 | 9/1966 | Walker | 166/86 |
| 3,404,736 | 10/1968 | Nelson et al. | 166/85 |
| 3,561,527 | 2/1971 | Nelson | 166/86 |
| 3,797,864 | 3/1974 | Hynes et al. | 285/140 |
| 3,827,488 | 8/1974 | Piazza et al. | 166/208 X |
| 4,131,287 | 12/1978 | Gunderson et al. | 277/236 X |
| 4,353,560 | 10/1982 | Tohill | 277/236 |
| 4,496,162 | 1/1985 | McEver et al. | 277/9.5 |
| 4,521,040 | 6/1985 | Slyker et al. | 285/140 |
| 4,548,273 | 10/1985 | Leieht et al. | 166/182 X |
| 4,572,515 | 2/1986 | Grazioli | 277/12 |
| 4,588,029 | 5/1986 | Blizzard | 166/120 |
| 4,615,544 | 10/1986 | Baugh | 285/18 |
| 4,714,111 | 12/1987 | Brammer | 166/182 |
| 4,719,971 | 1/1988 | Owens | 166/191 |
| 4,766,956 | 8/1988 | Smith et al. | 166/182 |

*Primary Examiner*—Hoang C. Dang

*Attorney, Agent, or Firm*—Vinson & Elkins

[57] ABSTRACT

The improved structure of the present invention includes a hanger having a landing shoulder for engaging the landing seat within a wellhead housing, a hanger holddown ring, an external sealing surface spaced from the internal sealing surface of the housing to form the annulus to be sealed, a seal assembly including a seal body having external metal seal legs diverging outward but having a free diameter less than the diameter of the housing internal sealing surface and internal metal seal legs converging inwardly and having a free diameter smaller than the diameter of the hanger external sealing surface, a lower body movably connected to the seal body and having an upstanding rim engaging the lower outer seal leg, an upper body movably connected to the seal body, a loading ring surrounding the upper portion of the seal body and engaging the upper outer seal leg, a lock down ring for securing said seal assembly to said hanger after the seal assembly has been set in loaded sealed position and a pin for retaining said loading ring against the upper outer seal leg to latch the seal assembly in loaded sealed position. In the modified form the seal body includes an upper outer seal leg extending upwardly and outward and having a free diameter less than the internal sealing diameter of the housing and a lower outer seal leg extending upwardly and having a free diameter larger than the internal sealing diameter of the housing.

17 Claims, 4 Drawing Sheets

HANGER AND SEAL ASSEMBLY

BACKGROUND

The present invention relates to an improved wellhead structure which is particularly adapted to subsea wells. Such structure includes a wellhead housing and an improved hanger and seal assembly which can be landed and set in a single trip.

Prior to the present invention many efforts have been made to provide a satisfactory hanger and seal assembly which allows the landing of the hanger, cementing and the setting of the seal in the annulus between the exterior of the hanger and the interior of the housing.

The R. W. Walker U.S. Pat. No. 3,273,646 discloses a hanger and seal assembly in which a snap ring is used to engage within a groove within the interior of the housing and the seal is run in the annulus above a port which allows the circulation of cementing to proceed before the seal is set responsive to rotation of the setting sleeve to force the seal downward below the port and to land on a shoulder against which it is compressed axially to cause it to expand radially and seal across the annulus.

The B. H. Nelson et al U.S. Pat. No. 3,404,736 discloses an annulus seal in which the seal is positioned within the annulus and held in unset position by a shear pin. The rotation of the setting sleeve causes the pin to shear and the seal and wedge ring to move downward to set the holddown ring and to compress the resilient seal into sealing engagement with the walls of the annulus.

The J. H. Hynes et al U.S. Pat. No. 3,797,864 discloses another annulus seal which is set by rotation to compress the seal axially. This seal assembly includes end rings with marginal lips which engage the end of the elastomeric seal and when the seal is compressed the lips are deformed into metal-to-metal sealing engagement with the walls of the annulus. The Slyker et al U.S. Pat. No. 4,521,040 discloses a modification of the Hynes et al structure.

Another hanger seal which is set by threading a nut on external threads of the hanger includes a seal body having a plurality of outer metal fins extending outwardly and downwardly and having elastomeric material between the fins, a plurality of inner metal fins extending radially inward and having elastomeric material between the fins and a connection between the seal body and a lower body having an upstanding rim which when the bodies are forced together sets the outer seal legs. Another hanger nut thread set seal includes both inner and outer seal legs which diverge and are loaded by inner and outer rims on the upper body and lower body to set all four seal legs into sealing engagement with the walls of the housing-hanger annulus.

Other prior patents have utilized metal end caps for an elastomeric annulus so that on setting of the seal by compression the lips of the end caps engage the walls of the annulus to both seal and also protect against the extrusion of the elastomeric material. An Example of such structure can be seen in the U.S. Pat. No. 4,496,162 to McEver et al (movement of the seal ring onto enlarged diameter portion of hanger sets the seal ring into sealed position).

The B. F. Baugh U.S. Pat. No. 4,615,544 discloses another type of annulus seal which is set by rotation of a setting sleeve. The seal includes a Z-shaped portion having a plurality of frustoconical metal rings positively connected by links and the grooves formed by the rings being filled with resilient elastomeric members. The seal is set by axial compression which forces the inner and outer ends of the rings and the resilient members into sealing engagement with the walls of the annulus to be sealed.

U.S. Pat. No. 4,572,515 to A. J. Grazoli discloses a seal for sealing between the walls of a seat ring and body in a ball valve. The seal is a ring of polytetrafluoroethylene which includes spaced apart, outwardly diverging sealing lips for sealing against the wall of the body and outwardly diverging sealing lips for sealing against the wall of the seat ring.

SUMMARY

The improved structure of the present invention includes a hanger having a landing seat for engaging the landing seat within a wellhead housing, a holddown ring normally positioned within an external recess in the hanger above the landing seat, an external sealing surface spaced from the internal sealing surface of the housing to form the annulus to be sealed, a seal assembly including a seal body having external metal seal legs diverging outward but having a free diameter less than the diameter of the housing internal sealing surface and internal metal seal legs converging inwardly and having a free diameter smaller than the diameter of the hanger external sealing surface, a lower body movably connected to the seal body and having an upstanding rim engaging the lower outer seal leg, an upper body movably connected to the seal body, a loading ring surrounding the upper portion of the seal body and engaging the upper outer seal leg, means for securing said seal assembly to said hanger after said seal assembly has been set in loaded sealed position and means for retaining said loading ring in loaded engagement with said upper seal leg latch said seal assembly in loaded sealed position.

An object of the present invention is to provide an improved hanger and seal assembly for use within a wellhead housing which provides improved metal-to-metal sealing against the inner and outer surfaces of the annulus.

Another object is to provide an improved hanger and seal assembly of the type described in which the seal assembly is latched in its sealed position with the loading on the seals being maintained.

A further object is to provide an improved hanger and seal assembly of the type described in which the seal assembly loading is increased by pressure differentials across the seal and pressure differentials do not lessen the sealing load.

Still another object is to provide an improved hanger and seal assembly of the type described which are simple to run in a single trip and when set within a wellhead housing will remain set until positively release to a suitable releasing tool.

BRIEF DESCRIPTION OF THE DRAWINGS

These and other objects and advantages of the present invention are hereinafter set forth and described with reference to the drawings wherein.

DESCRIPTION OF THE PREFERRED EMBODIMENTS

Figure 1:
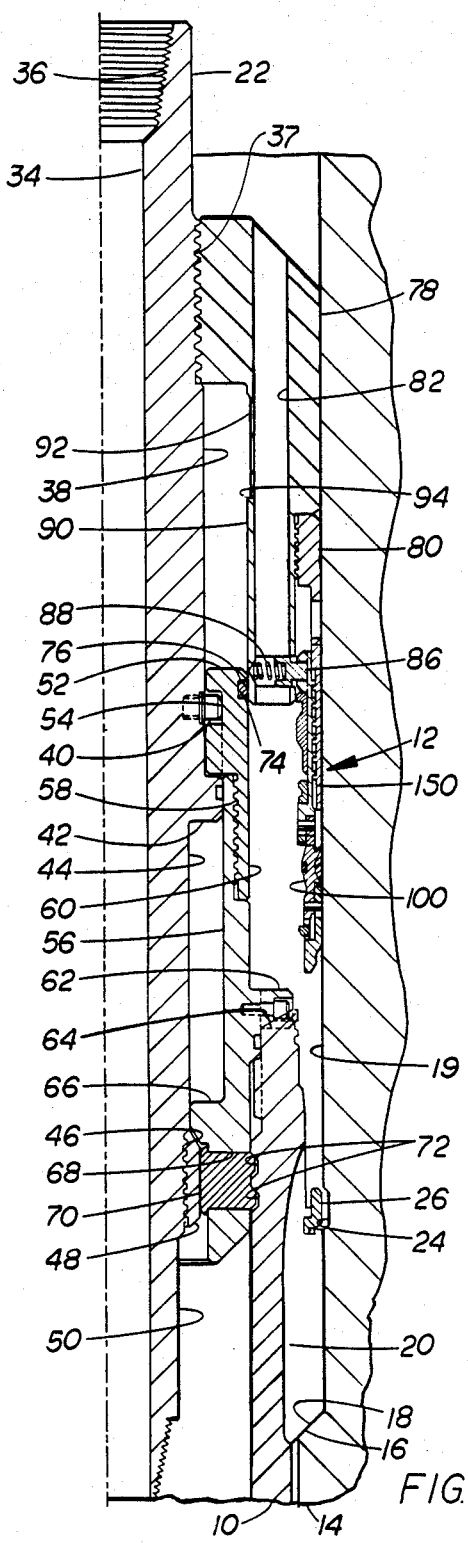
FIG. 1 is a partial sectional view of the improved hanger and seal assembly being lowered into a wellhead housing and with the hanger landed on the housing seat ready for cementing.
Figure 2:
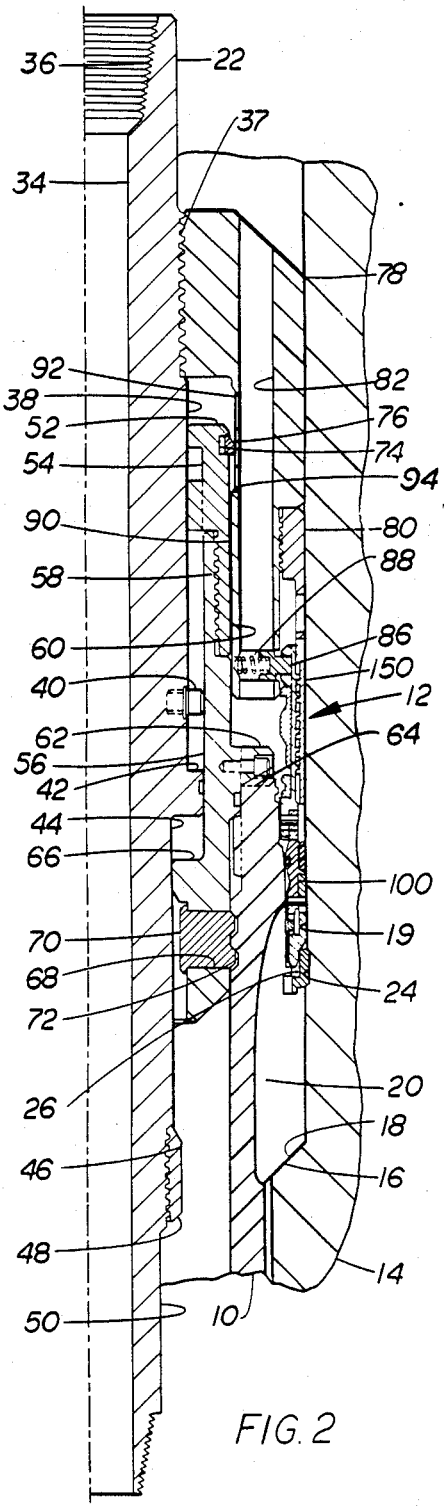
FIG. 2 is a similar partial sectional view of the improved structure with the seal assembly being positioned within the annulus between the exterior of the hanger and the interior of the housing and with the hanger lockdown positioned in engagement with the housing groove.
Figure 3:
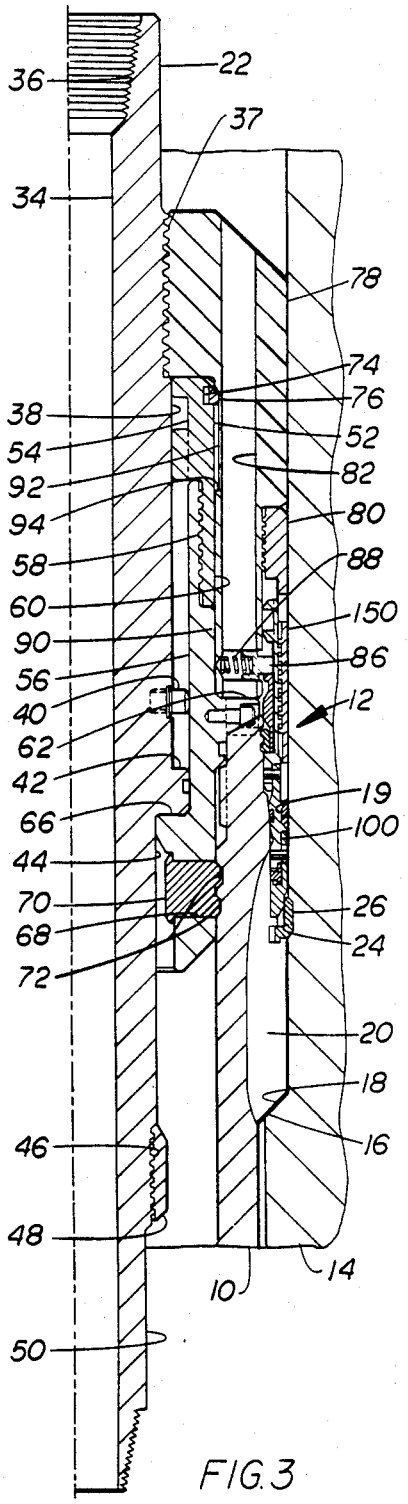
FIG. 3 is another similar partial sectional view of the improved structure with the seal assembly in set position and ready to testing.
Figure 4:
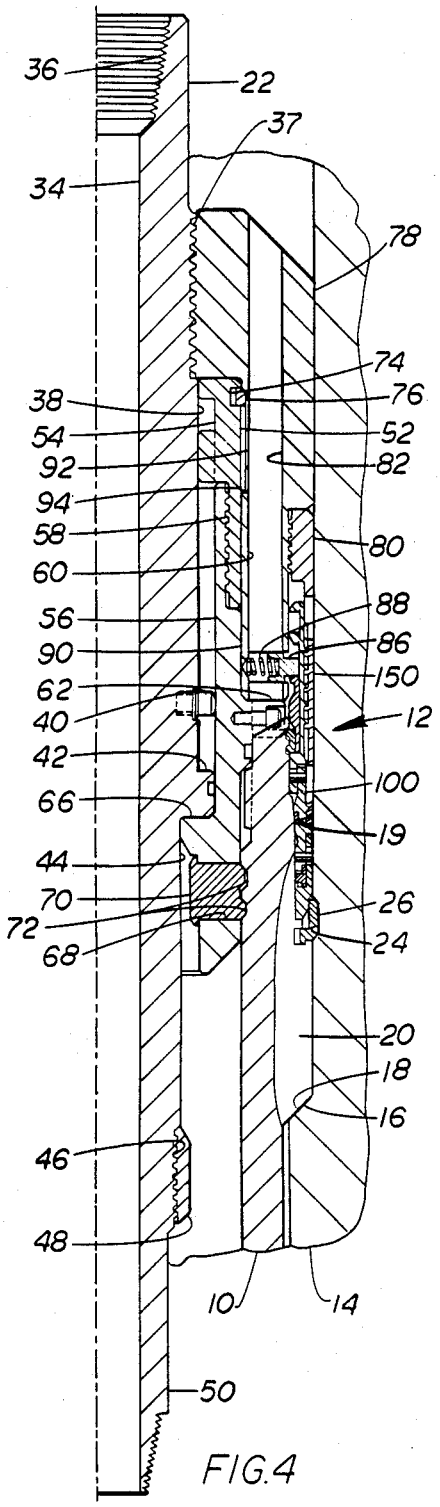
FIG. 4 is another partial sectional view of the improved structure with the seal assembly latch in set position to secure the seal loading.

As shown in FIG. 1, improved hanger 10 and seal assembly 12 are positioned within housing 14 with hanger 10 having its landing shoulder 16 landed on internal housing shoulder 18. Hanger 10 includes the usual slots 20 which allow flow of fluid thereby during the cementing step. In this position both hanger 10 and seal assembly 12 are secured to running tool 22. Housing 14 includes internal groove 24 which is positioned above its landing shoulder 18 and opposite hanger lockdown ring 26. Ring 26 is positioned in surrounding relationship to hanger above shoulder 28 and is biased inwardly so that it does not extend beyond the diameter of hanger 10 below shoulder 28. Lip 30 extends upwardly at the exterior of shoulder 28 and engages depending lip 32 on lockdown ring 26 to retain ring 26 in engagement with hanger shoulder 28 when it is in its set position engaging groove 24 as hereinafter explained. It should be noticed that some of the details of structure of hanger 10 and seal asssembly 12 are more easily seen in FIGS. 5 and 6 while FIGS. 1,2,3 and 4 provide better overall views of the relative structure positions and running tool 22.

Running tool 22 includes mandrel 34 having upper internal threads 36 for connection to a running string (not shown), external threads 37, external surface 38 below threads 37 with J pin 40 secured within the lower portion of surface 38 and projection 42 which forms the lower end of surface 38. Surface 44 of mandrel 34 below projection 42 extends downward to external threads 46 on which ring 48 is threaded and surface 50 below threads 46 is of smaller diameter than the inner diameter of the mating threads on support ring 48 so that ring 48 may be readily installed on mandrel 34. Sleeve 52 is positioned with its interior portion during running in engagement with the upper surface of projection 42 and includes J slot 54 which coacts with J pin 40 as hereinafter described. Hanger support sleeve 56 is threaded onto the internal threads 58 of depending rim 60 of sleeve 52 and includes outer projection 62 which engages in slot 64 on the upper end of hanger 10 during running, inner projection 66 and opening 68 which receives hanger support lugs 70. Hanger support lugs 70 are held in their outer position by engagement with ring 48 and in such position engage within internal grooves 72 in hanger 10 so that hanger 10 is supported by tool 22 during running. Groove 74 on the upper exterior of sleeve 52 includes snap ring 76 therein. Snap ring 76 is biased to extend when free to do so as hereinafter explained.

Seal assembly support ring 78 is threaded on threads 37, is threaded to loading ring 80, and includes fluid passages 82 extending therethrough to allow return flow of fluids during the cementing step. Pin 86 is supported in the lower end of ring 78 and is biased by spring 88 to extend outwardly as shown. The lower interior surface 90 of ring 78 is positioned to engage the upper exterior surface of sleeve 52 and to retain snap ring 76 within groove 74. The upper end of ring 78 is recessed at 92 to provided upwardly facing shoulder 94 at its lower end.

Figure 5:
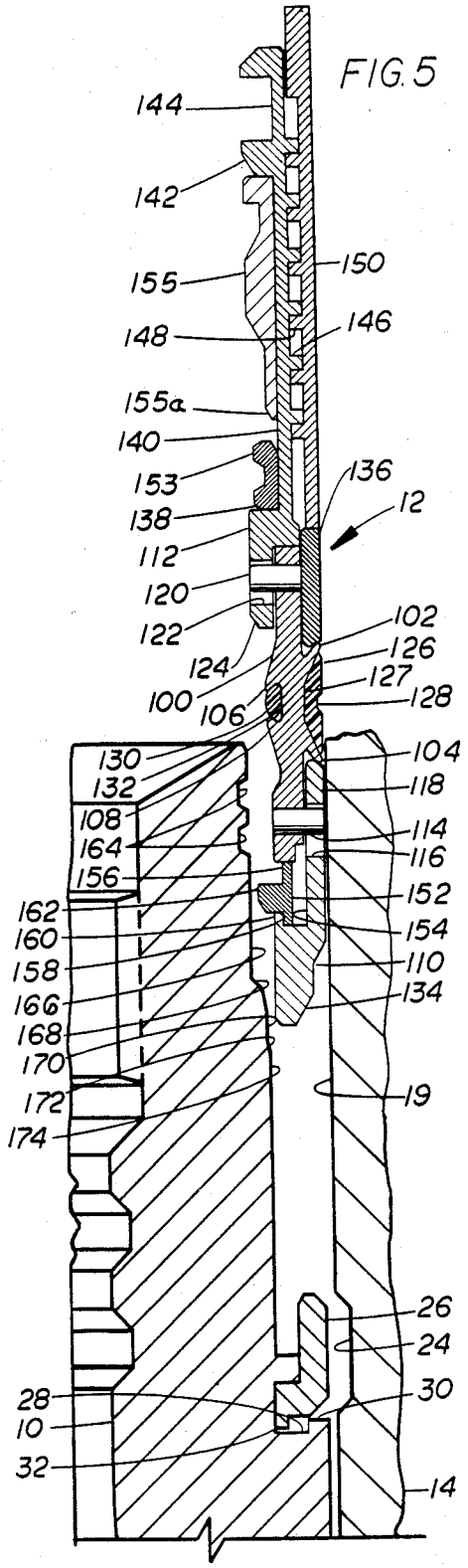
FIG. 5 is an enlarged partial sectional view illustrating the lowering of the seal assembly into the annulus between the hanger and the housing.
Figure 6:
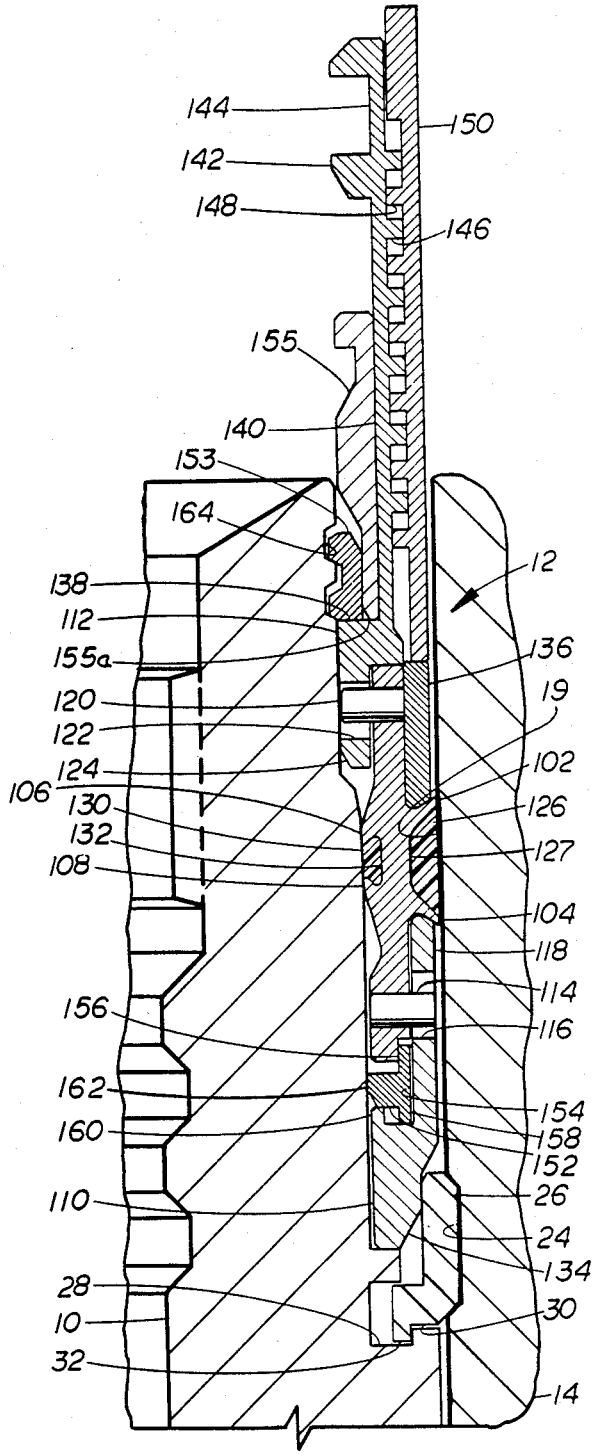
FIG. 6 is an enlarged partial sectional view illustrating the set position of the seal assembly before the setting of the seal latch to secure the loading on the seal legs.

Seal assembly 12 includes seal body 100 having upper and lower diverging outer legs 102 and 104 and upper and lower converging inner legs 106 and 108, lower body 110 and upper body 112 as best seen in FIGS. 5 and 6. Pin 114 is secured within the lower portion of seal body 100 and is positioned within slot 116 in the outer upstanding rim 118 of lower body 110 to connect seal body 100 to lower body 110 while allowing relative axial movement therebetween. Pin 120 is secured within the upper portion of seal body 100 and engages within slot 122 in depending rim 124 of upper body 112.

Resilient material 126, such as a suitable elastomer, is positioned in recess 127 between outer legs 102 and 104 and includes central outer recess 128 to allow for the movement of legs 102 and 104 in sealing without totally filling the space between the legs so that the needed sealing movement can be completed and is not impeded by the inability to compress the material 126. Material 130, such as a suitable elastomer, is positioned in the recess 132 between inner legs 106 and 108.

The lower exterior of lower body 110 includes tapered surface 134 which is angled downwardly and inwardly and is adapted to engage the upper interior of holddown ring 26 to wedge it outwardly into tight engagement within internal housing groove 24. Load ring 136 surrounds the upper exterior of seal body 100 and has its lower end in engagement with upper outer seal leg 102. Upper body 112 extends upwardly and includes upwardly facing shoulder 138 with internal surface 140 extending to upper projections 142 which includes a suitable J slot 144 to receive pin 86 and also includes external threads 146 which interengage with internal threads 148 on latching sleeve 150. The lower portion of latching sleeve 150 extends downwardly around upper body 112 and has its lower end in engagement with the upper end of load ring 136. Split release ring 152 is positioned in recess 154 in lower body 110 and includes upper flange 156 which is in engagement with the lower end of seal body 100 during running, lower flange 158 which is positioned in recess 154 outward of lip 160 and inner projection 162 which extends inward so that as seal assembly 12 is lowered into the annulus between hanger 10 and housing 14 it is wedged into recess 154 so that upper flange 156 disengages from the lower end of seal body 100 allowing relative movement between seal body 100 and lower body 110. Seal latching ring 153 is positioned within surface 140 and rests on shoulder 138 of upper body 112. Actuating sleeve 155 is positioned below projection 142 and includes lower tapered surface **155*a* which is suitable for engaging the upper exterior surface of ring 153 to wedge it inwardly to secure seal assembly 12 with respect to hanger 10**.

The interior of hanger 10 is provided with a suitable profile including internal grooves 72 and the exterior of hanger 10 includes upper grooves 164, cylindrical surface 166 below grooves 164, tapered surface 168 extending to upper sealing surface 170 and shallow tapered surface 172 extending to lower sealing surface 174.

Hanger 10, sealing assembly 12 are assembled on running tool 22 for running as shown in FIG. 1. When hanger landing shoulder 16 has been landed on housing landing shoulder 18, operations such as cementing may be conducted as return flow of the circulating fluids up the annulus is ensured by slots 20 in the exterior of hanger 10 and passages 82 through seal assembly support ring 78. Upon completion of such operations, mandrel 34 is rotated 45 degrees to the right to unjay pin 40 from J slot 54. This effectively releases the connection between mandrel 34 and sleeve 52 to allow downward movement of mandrel 34, seal assembly support ring 78 and seal assembly 12. Seal assembly 12 moves downward so that tapered surface 134 on the lower end of lower body 110 moves behind lockdown ring 26 to wedge it into tight engagement with internal housing groove 24 and thus secure hanger 10 from axial movement with respect to housing 14. This downward movement of seal assembly 12 also causes projection 162 on split release ring 152 to engage the exterior of hanger 10 so that it is forced outward into position disengaging upper flange 156 from supporting engagement with the lower end of seal body 100. This allows further downward movement of seal body 100 with respect to lower body 110 which, because of the engagement of the upper end of rim 118 of lower body 110 with lower outer seal leg 104 and the seating of the lower end of lower body 110 on shoulder 31, results in an upward loading force on lower outer seal leg 104 to lift it into sealing engagement with internal housing sealing surface 19 above groove 24. In this lower position of seal body 100, lower inner seal leg 108 is in sealing engagement with lower sealing surface 174 and upper inner seal leg 106 is in sealing engagement with upper sealing surface 170. The above described movement of the components is ensured by the application of the weight of the running string to seal assembly 12.

At the completion of this downward movement of seal assembly 12, mandrel 34 is rotated an additional 20 degrees to allow further downward movement of the upper portion of seal assembly 12. This rotation causes the disengagement of pin 86 from slot 144 in the upper end of upper body 112. Thereafter, the application of the weight of the string is further exerted on latching sleeve 150 and load ring 136. This exerts a load on upper outer seal leg 102 to move it into sealing engagement with internal housing sealing surface 19. The additional downward movement brings pin 86 into engagement with the upper end of actuator sleeve 155 to move it downwardly with its lower tapered surface 155*a* engaging and wedging seal latching ring 153 inward into tight engagement with grooves 164 on the exterior of hanger 10. In this position all seals are loaded and latching ring 153 prevents any movement of upper body 112, seal body 100 and lower body 110 with respect to each other and to hanger 10. As shown in FIG. 6, in this position the threads 148 of latching sleeve 150 and threads 146 of upper body 112 are not in tight engagement so that it is desirable to further rotate mandrel to cause latching sleeve 150 to move into tight engagement under the threads 146 of upper body 112. This can further load the seal assembly but primarily sets the latching means so that the seal assembly loading is not relieved during retrieval of running tool 22. The loading of outer seal legs as described also creates additional loading on the inner legs.

Running tool 22 is easily retrieved by lifting on the running string and orienting the string to cause pins 86 to pass through a slot (not shown) in projection 142 on the upper end of upper body 112 and into J slot 144. Snap ring 76 will engage shoulder 94 of the inner surface of sleeve 78 to lift hanger support sleeve 56. Hanger support lugs 70 will disengage from grooves 72 because hanger support ring 48 is positioned below lugs 70 and the taper on the upper ends of grooves 72 allows lugs 70 to cam inward out of engagement with grooves 72. Since the engagement between latching sleeve 150 and load ring 80 is only a splined connection, the lifting of running tool 22 lifts load ring 80 clear of latching sleeve 150. With seal assembly 12 securely latched to hanger 10 and with pin 86 being disengaged from projection 142, the retrieval is a straight upward lift. It should be noted that the preferred application for the improved hanger and seal assembly of the present invention is in subsea wellhead but it may readily be utilized in other wellheads. This is true also of the modified form of the invention disclosed in FIGS. 7 and 8 and hereinafter discussed.

Figure 7:
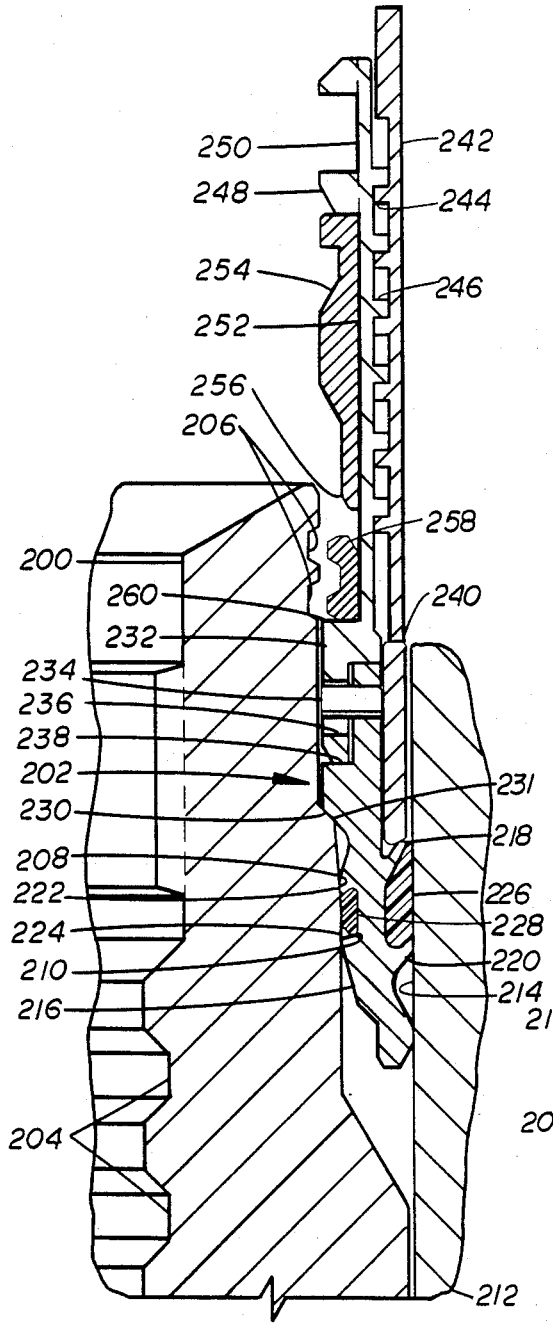
FIG. 7 is an enlarged partial sectional view of a modified form of the present invention illustrating the position of the seal within the annulus but prior to the setting of the upper seal leg.
Figure 8:
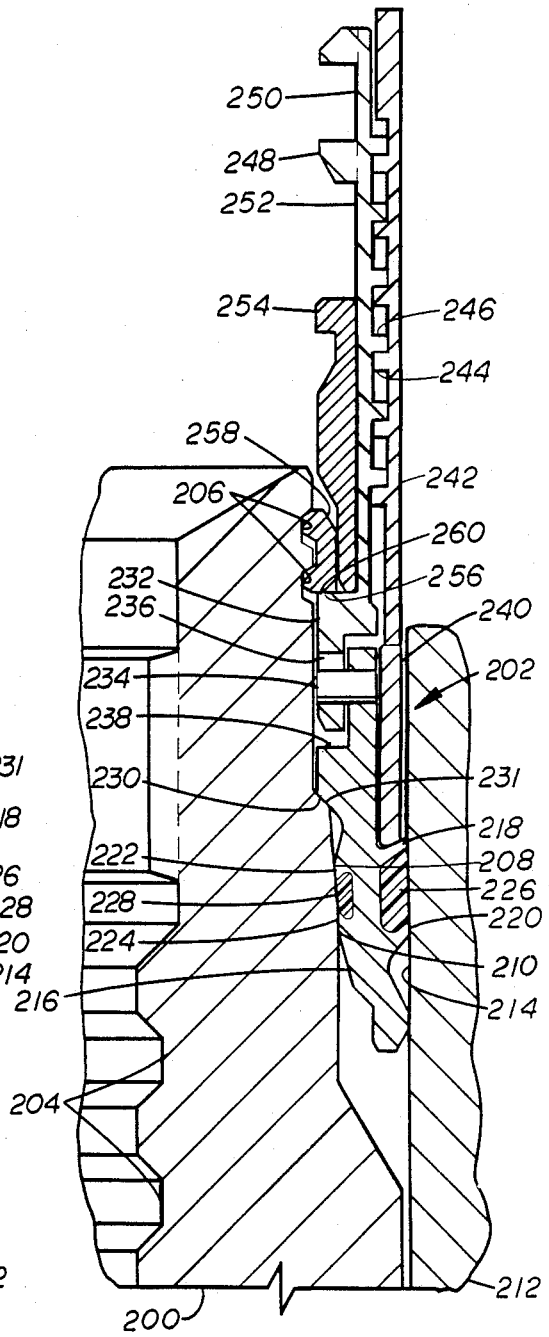
FIG. 8 is an enlarged partial sectional view of the modified form of the invention but illustrating the loaded and latched position of the seal assembly.

A modified form of the present invention is shown in FIGS. 7 and 8 which includes hanger 200 and seal assembly 202. Hanger 200 is substantially the same as hanger 10 and includes the usual landing seat and slots (not shown) and possibly, if desired, a snap ring lock down (not shown). Hanger 200 does include the internal profile including internal grooves 204 by which the running tool (not shown) is connected thereto. External grooves 206 on the upper portion of the exterior of hanger 200 are similar to grooves 164 on hanger 10 and the external surfaces including upper sealing surface 208 and lower sealing surface 210 are the same as such surfaces on hanger 10. Housing 212 includes internal sealing surface 214 and the usual landing shoulder (not shown) and lockdown groove (not shown) if desired.

Seal assembly 202 includes seal body 216 having outer upwardly directed upper and lower legs 218 and 220 and inner upper and lower converging legs 222 and 224. Resilient material 226 is positioned between outer legs 218 and 220 and fills the space therebetween. Resilient material 228 is positioned between inner legs 222 and 224 and fills the space therebetween. Upper inner leg 222 is adapted to seal against upper sealing surface 208 and lower leg 224 is adapted to seal against lower sealing surface 210. The lower end of seal body 216 enters the annular space between hanger 200 and housing 212. Lower outer leg 220 is positioned to engage internal housing sealing surface 214 as it enters the annular space while upper outer leg 218 is spaced therefrom. Inner seal legs 222 and 224 come into sealing engagement with their respective sealing surfaces on the exterior of hanger 200. Landing of seal assembly 202 is provided when shoulder 230 on the lower interior of seal body 216 comes into engagement with external landing shoulder 231 on hanger 200. In this manner the desired sealing position of seal assembly 202 is ensured. Upper body 232 which is connected to seal body 216 by pin 234 which is secured in seal body 216 and extends into slot 236 in upper body 232. The running tool is then actuated to cause upper body 232 to move downward until its lower surface is in engagement with upwardly facing shoulder 238 on the interior of seal body 202. Load ring 240 surrounds the upper end of seal body 216 and has its lower end in engagement with upper outer leg 218. Latch sleeve 242 is position in surrounding relation to the upper end of upper body 232 and includes internal threads 244 which are in loose engagement with external threads 246 on the upper exterior of upper body 232. The lower end of latch sleeve 242 is in engagement with the upper end of load ring 240. The interior of upper body 232 includes upper projection 248 having a suitable J slot 250 therein, internal surface 252 with actuating sleeve 254 having its lower inner surface 256 tapered and being positioned within surface 252 immediately under projection 248 and seal latching ring 258 positioned within the lower end of internal surface 252 and supported against upwardly facing shoulder 260 on upper body 232.

When sufficient load has been applied by the pin connecting the running tool with J slot 250, load ring 240 will move upper seal leg 218 downwardly and outwardly into sealing engagement with internal sealing surface 214. Thereafter disengagement of the pin from J slot 250 allows the running tool to be lowered so that actuating sleeve 254 moves downwardly and wedges seal latching ring 258 into tight latching engagement with grooves 206 which prevents subsequent upward movement of upper body 232 with respect to seal body 216 and hanger 200. Latching sleeve 242 in then rotated to bring its threads 244 into tight engagement with threads 246 on the exterior of upper body 232 to thereby ensure that the loading of outer seal legs 218 and 220 is not thereafter relieved. It should be noted that the movement of upper seal leg 218 into its set position creates an increase in the loading of lower seal leg 220 since the space between the legs is filled with the resilient material which is substantially noncompressible and will transmit the loading of the upper leg to the lower leg. Further, the loading of the outer legs as described also creates additional loading on the inner legs.

The improved seal assembly also is responsive to pressure since the pressure area to which the seals from above or below in the preferred form of the invention are exposed is the full area of the sealed annulus but the reaction area is that reaction force which either the lower body rim or the load ring applies to its seal leg. This ensures that the seals will always retain the pressures. In the case of the modified form of the invention the same is true with respect to the force of pressure when applied from below the seal assembly.

Further, with the use of the latch sleeve and its threaded engagement with the upper body threads, the loading on the seal legs is maintained and the seal assembly is latched to the hanger by the seal latching ring. The improved structure is readily run with the hanger, landed, operations such as cementing are completed and then the seal assembly is actuated into sealed position and latched in sealed position and then the running tool may be easily retrieved all on a single trip of the running string.

What is claimed is:

1. A hanger and seal assembly for installation in a wellhead housing having an internal landing shoulder and an internal sealing surface, a hanger having an external landing shoulder for seating on the housing landing shoulder and an external sealing surface, a seal assembly including a seal body having an upper outer annular seal leg and a lower outer annular seal leg, the upper outer annular seal leg extending upwardly and outwardly and having its largest free diameter at its outer end less than the diameter of the internal housing sealing surface and inner upper and lower annular seal legs which converge inwardly toward each other and have their smallest free inner diameter at their inner ends less than the diameter of the external hanger sealing surface, an upper load ring surrounding the upper portion of said seal body and engaging the upper outer annular seal leg, an upper body movably connected to said seal body and movable with respect thereto, means connecting said upper body to said load ring whereby downward movement of said upper body with respect to said seal body moves said load ring downwardly on said upper outer annular seal leg to cause said annular seal leg to move downwardly and outwardly into sealing engagement with the internal housing sealing surface, and means for retaining said upper outer annular seal leg in sealing engagement with the internal housing sealing surface.

2. A hanger and seal assembly according to claim 1 wherein said lower outer annular seal leg extends downwardly and outwardly and has its largest free outer diameter less than the diameter of said internal housing sealing surface and including a lower body movably connected to said seal body and having an outer upstanding rim surrounding the lower portion of said seal body and engaging the lower outer annular seal leg, relative movement of said lower body with respect to said seal body moving said lower outer annular seal leg downward against the upper end of said lower body rim to move said lower outer annular seal leg outwardly and upwardly into sealing engagement with said internal housing sealing surface.

3. A hanger and seal assembly according to claim 2 including means for releasably preventing movement of said seal body with respect to said lower body.

4. A hanger and seal assembly according to claim 3 wherein said movement preventing means includes a recess in the interior of said lower body, a split release ring positioned within the outer portion of said lower body recess in supporting engagement with said seal body, and means on said release ring for moving it outwardly on landing of said seal assembly around said hanger to allow disengagement of the supporting engagement with said seal body and to allow relative movement between the seal body and the lower body.

5. A hanger and seal assembly according to claim 4 wherein said means for moving said release ring includes an inner projection on said release ring engaging the exterior surface of said hanger when said seal assembly is lowered therearound to move the release ring outwardly.

6. A hanger and seal assembly according to claim 1 wherein said lower outer annular seal leg extends upwardly and outwardly and has its largest free outer diameter at its outer end larger than the diameter of the internal housing sealing surface whereby entry of said seal assembly within said internal housing sealing surface bring said lower outer annular seal leg into sealing engagement with said internal housing sealing surface.

7. A hanger and seal assembly according to claim 1 including resilient sealing means positioned between said outer annular seal legs, and resilient sealing means positioned between said inner annular seal legs.

8. A hanger and seal assembly according to claim 7 wherein the resilient sealing means between said outer annular seal legs is recessed to allow for the sealing movements of said outer annular seal legs.

9. A hanger and seal assembly according to claim 1 wherein said upper outer annular seal leg retaining means includes means for securing the upper body to said hanger to prevent further relative movement of the upper body with respect to said seal body, and means for retaining the loaded position on said load ring with respect to said upper outer annular seal leg after completion of its loading.

10. A hanger and seal assembly according to claim 9 wherein said means for securing said upper body to said hanger includes an external groove in the upper exterior of said hanger, a latching ring carried by said upper body, and an actuating sleeve carried by said upper body and being slidable therein to engage and move said latching ring into said external hanger groove to secure said upper body with respect to said hanger.

11. A hanger and seal assembly according to claim 9 wherein said means retaining the loading of said upper outer annular seal leg includes a latching sleeve surrounding the upper portion of said upper body and engaging said loading ring, and means providing threaded interengagement between said latching sleeve and said upper body to retain the loading of said loading ring on said upper outer annular seal leg.

12. A hanger annulus seal for sealing between the exterior surface of a first tubular member and the interior surface of a second tubular member comprising a seal body having a pair of outer annular seal legs extending outwardly from said body at an angle and a pair of inner annular seal legs converging inwardly toward each other from said body, the inner annular seal legs having their smallest free internal diameter smaller than the diameter of the exterior surface of the first tubular member against which the inner annular seal legs are to seal, at least one of the outer annular seal legs having its largest free outer diameter smaller than the diameter of the interior surface of the second tubular member against which the outer annular seal legs are to seal, an upper loading ring surrounding the upper portion of the seal body above the upper outer annular seal leg, means for exerting a downward force on said upper loading ring to provide a loading force on said upper outer annular seal leg to bring it into sealing engagement with the interior surface of the second tubular member against which it is to seal, and means for securing said seal assembly in its sealed position.

13. A hanger annulus seal according to claim 12 wherein said outer annular seal legs diverge outwardly and each have their largest free diameter at their outer ends less than the diameter of said internal housing sealing surface.

14. A hanger annulus seal according to claim 13 including a lower body movably connected to said seal body and having an upstanding rim positioned in engagement with said lower outer annular seal leg whereby on landing of the lower body continuing movement of said seal body loads said lower outer annular seal leg to move it outward into sealing engagement with said internal housing sealing surface.

15. A hanger annulus seal according to claim 14 including means for releasably preventing relative movement of said seal body and said lower body prior to the landing on said hanger.

16. A hanger and seal assembly for installation in a wellhead housing having an internal landing shoulder, an interior sealing surface and an internal groove above the landing shoulder comprising a hanger having an external landing shoulder for seating on the housing landing shoulder, an external groove receiving an inwardly biased latching ring and an exterior sealing surface, a seal assembly including a seal body having a pair of outer annular seal legs and a pair of inner annular seal legs, the inner annular seal legs extending beyond the inner surface of the seal body for sealing against the exterior sealing surface of said hanger, the outer annular seal legs having a diameter less than the inner housing sealing surface, the upper outer annular seal leg extending upwardly at an angle toward the interior housing sealing surface against which it is to seal, the lower outer seal annular leg extending downwardly at an angle toward the housing sealing surface against which it is to seal, the upper inner annular seal leg extending downwardly at an angle toward the hanger sealing surface against which it is to seal and the lower inner annular seal leg extending upwardly at an angle toward the hanger sealing surface against which it is to seal, a lower body having an upwardly extending outer rim and a lower depending portion having a lower outer surface tapering downwardly and inwardly and positioned to engage within the latch ring within the external hanger groove, means connecting the lower body to the seal body so that axial movement is available between the two bodies upon landing of the seal assembly between the hanger and the housing, an upper body, means connecting the upper body to the seal body so that axial movement is available between the two bodies, a load ring surrounding the upper portion above the upper outer annular seal leg, landing of said seal assembly on said hanger causing said lower outer surface of said lower body to wedge said latching ring outwardly into said internal housing groove to latch said hanger in its seated position and further movement of said seal assembly moving said seal body downward with respect to said lower body rim to urge said lower outer annular leg upwardly and outwardly into sealing engagement with said internal housing sealing surface, downward movement of said upper body and said sleeve moving said sleeve downwardly with respect to said upper outer annular leg, urging said upper annular outer leg downwardly and outwardly into sealing engagement with said internal housing sealing surface, and means for latching said upper body in its downward position to retain the seal assembly in its set position.

17. A hanger annulus seal for sealing between the exterior surface of a first tubular member and the interior surface of a second tubular member comprising a seal body having a pair of outer annular seal legs, the upper annular seal leg extending outwardly and upwardly and the lower annular seal leg extending outwardly and downwardly, and a pair of inner annular seal legs, the upper inner annular seal leg extending downwardly and inwardly and the lower inner annular seal leg extending upwardly and inwardly, the inner annular seal legs having their smallest free internal diameter smaller than the diameter of the exterior surface of the first tubular member against which the inner annular seal legs are to seal, the outer annular seal legs having their largest free outer diameter smaller than the inner diameter of the interior surface of the second tubular member against which they are to seal, an upper loading ring surrounding the upper portion of the seal body above the upper outer annular seal leg, and a lower body movable connected to said seal body and having an upstanding rim surrounding the lower portion of the seal body and engaging the lower outer annular seal leg, the downward movement of the seal body on the lower body forcing the lower outer annular seal leg outwardly into its sealing position and the downward movement of the upper loading ring forcing the upper outer annular seal leg downwardly and outwardly into its sealing position.

* * * * *